United States Patent [19]

Van Tol

[11] 4,068,211

[45] Jan. 10, 1978

[54] VEHICLE IDENTIFICATION SYSTEM HAVING ERROR DETECTION MEANS

[75] Inventor: Nicolaas Van Tol, Hilversum, Netherlands

[73] Assignee: U.S. Philips Corporation, New York, N.Y.

[21] Appl. No.: 616,043

[22] Filed: Sept. 23, 1975

[30] Foreign Application Priority Data

Oct. 1, 1974 Netherlands ..... 7412919

[51] Int. Cl.[2] ..... G08G 1/00

[52] U.S. Cl. ..... 340/32; 246/34 R; 340/146.1 D; 340/408; 343/6.5 SS

[58] Field of Search ..... 340/408, 32, 38 L, 150, 340/146.1 D, 146.1 F, 23, 163, 152 T; 325/21, 22, 8; 343/6.5 R, 6.5 SS, 7.5, 7 VM, 6.8; 246/167 R, 63 R, 63 A, 34 R, 187 B; 178/2 A

[56] References Cited

U.S. PATENT DOCUMENTS

| | | | |
|---|---|---|---|
| 3,388,393 | 6/1968 | Graham et al. | 343/7.5 |
| 3,394,349 | 7/1968 | Day | 340/163 |
| 3,456,239 | 7/1969 | Glasson | 340/146.1 D |
| 3,510,870 | 5/1970 | Woollvin | 343/6.8 LC |
| 3,576,947 | 5/1971 | Kruger | 340/146.1 D |
| 3,790,699 | 2/1974 | Da Silva | 325/21 |
| 3,952,285 | 4/1976 | Falck | 340/152 T |

*Primary Examiner*—John W. Caldwell, Sr.
*Assistant Examiner*—James J. Groody
*Attorney, Agent, or Firm*—Frank R. Trifari; Bernard Franzblau

[57] ABSTRACT

Vehicle identification system comprising a carrier period detector in which, to increase the accuracy of identification signals received, the identification signal is rejected and a new identification signal is requested whenever one period is absent from the carrier signal received.

10 Claims, 3 Drawing Figures

VEHICLE IDENTIFICATION SYSTEM HAVING ERROR DETECTION MEANS

The invention relates to a vehicle identification system comprising an interrogation unit for the wireless transmission of an interrogation signal to a response unit on the vehicle to be identified and a receiver for the detection of an identification signal transmitted to the receiver from the vehicle response unit by wireless transmission in response to said interrogation signal.

In modern traffic control systems there is a need for devices for the identification of certain vehicles, such as motor buses, ambulances, fire engines and similar vehicles, which renders it possible to give them priority by controlling the traffic lights. The operation of such devices must be very reliable. In practice it is difficult to satisfy this requirement.

One of the reasons is that for practical considerations a response unit on a vehicle cannot use the accumulator already present in the vehicle and must therefore be provided with an energy source of its own in the form of a built-in battery. To avoid overloading this energy source and thereby extend its life and consequently its reliability, the identification signal is radiated with a relatively low power. The result is that interference signals affect it to a relatively large degree.

In order not to limit the mobility of the vehicles to be identified and to enable the control of individual lanes, such systems have loop-shaped aerials fitted in the road surface. This means that the distance between the response unit on a vehicle and an aerial in the road surface is limited to a minimum distance of about 35 cm so that the ability to reduce the influence of interferences on the signal by decreasing the said distance is bound to this limit. Moreover, owing to the finite dimensions of the loop-shaped aerial and the high vehicle speeds at which the device must still be able to operate, the time to identify a vehicle is very short.

However, the reliability is particularly affected by noise voltages which are peculiar to the field of application of the system such as noise voltages of a large amplitude and a long duration, caused by currents in tram rails during accelerating and braking of a tram or noise voltages over a broad frequency spectrum owing to sparking of a pantograph on an overhead contact wire. Furthermore, owing to the geometrical location, noise voltages may be generated owing to earth currents etc.

Vehicle identification systems of the above mentioned type are already known in which, to increase the reliability, signal redundancy is applied to the system by the use of codes which are less sensitive to interference. This requires extra bits or the transmission of the identification signal several times one after another and a receiver with a majority decision circuit. However, such systems have the drawback that the total duration of the identification signal is considerably increased, which requires on the one hand more transmission energy and on the other hand reduces the possibility for the repetition of the interrogation and response procedure or considerably reduces the maximum permissible vehicle speed.

These drawbacks also apply to a known vehicle identification system which is particularly suitable for rail-bound vehicles and in which, to increase the reliability, use is made of a test signal immediately preceding the identification signal. Another drawback of this system is that interferences which occur after the test signal cannot be detected according to this procedure.

An object of the invention is to avoid the said drawbacks and to realize a reliable vehicle identification system in a very simple manner.

The system according to the invention is characterized in that it comprises a carrier period detector and switching means connected to it for resetting the receiver to the initial position when it is detected, during the reception of an identification signal, that the carrier signal is absent for a given small number of periods.

According to another measure the system, according to the invention, is characterized in that the carrier period detector is connected to the interrogation unit so as to cause the latter to supply an interrogation signal when it is detected that the carrier signal is absent for a given small number of periods during the reception of an identification signal.

The invention will be further explained with reference to an embodiment shown in the accompanying drawing, in which.

Figure 1:
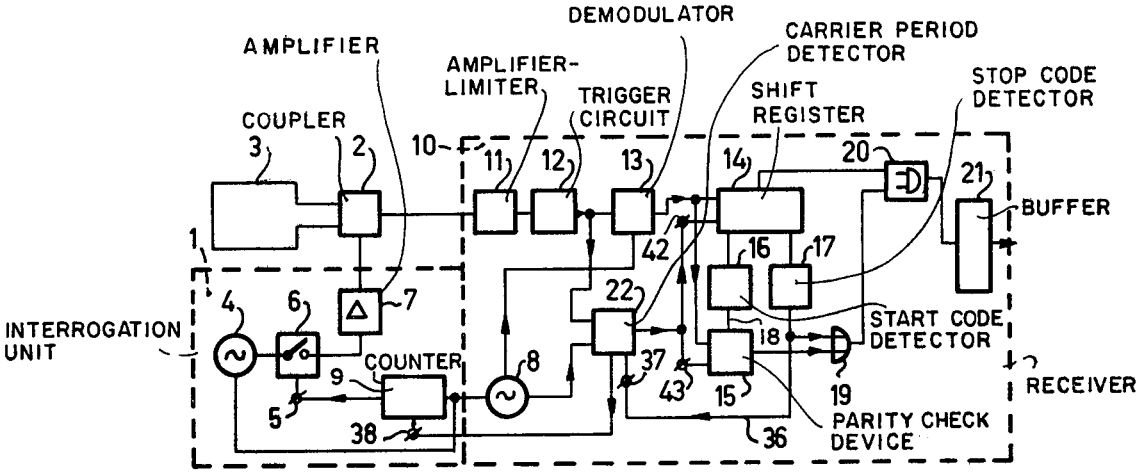
FIG. 1 shows a vehicle identification system according to the invention.

The vehicle identification system shown in FIG. 1 comprises an interrogation unit 1 which is connected by means of a coupling device 2 to a loop-shaped aerial 3 which is fitted in the road surface. Periodically, for example 40 times per second, this interrogation unit transmits for a short period, for example for 2 msec, an interrogation signal at a carrier frequency of, for example, 100 kHz. To this end interrogation unit 1 comprises a carrier wave generator 4 which is connected to the coupling device 2, through a switch 6, which is provided with a control terminal 5, and an amplifier 7. Furthermore, the device comprises a crystal-stabilized clock pulse generator 8 connected to carrier generator 4 to stabilise the carrier frequency and also connected to the control terminal 5 through a logic circuit 9, which is incorporated in the interrogation unit 1. By means of the logic circuit 9, which may be a counter, the desired control signal, in the form of a pulse which is produced 40 times per second and has a pulse duration of 2 msec, is generated in a known manner from a clock pulse train supplied by the clock pulse generator 8.

As soon as a vehicle equipped with a response unit, which is not shown in the figures but which may be, for example, of a known type, comes within the range of the aerial 3, this response unit will transmit an identification signal in response to an interrogation signal. Such an identification signal is, for example, composed of a start code which is the same for all response units and which serves, inter alia, to bridge the duration of the interrogation signal, a recognition code which is characterisitc of the relevant response unit and which is provided with a parity bit, and a stop code which is also the same for all response units. These codes are composed of binary signals, the total number of bits of the total identification signal being, for example, 32. The two values of the binary signals are transmitted to the aerial 3 by means of a frequency-jump-modulated carrier at frequencies of 90 and 100 kHz respectively.

Owing to the relatively low frequencies of the carrier signals the transmission of one bit of the identification signal requires about 0.5 msec, which means that the duration of the identification signal is about 16 msec.

With a length of the aerial loop in the direction of travel of 2 meters, and when a vehicle reaches the aerial loop at the most unfavorable instant, i.e., at an instant such that the response unit of the vehicle has just missed an interrogation signal and when a repetition of the interrogation procedure is required, the maximum vehicle speed is 116 km/hour in practice.

Any identification signal received by the aerial 3 is fed to a receiver 10 through the coupling device 2, for example, a hybrid circuit. In this receiver 10 the identification signal is, in the following sequence, amplified and limited in an amplifier-limiter 11, processed in a trigger circuit 12 to obtain a rectangular signal whose level variations coincide with the zero-crossings in the carrier signal received, demodulated in known manner in a demodulator 13 under the control of a clock-pulse signal delivered by clock-pulse generator 8, and then fed for decoding to both a shift register 14 and a parity check device 15. Start-code detector 16 and stop-code detector 17 are connected to the shift register. As soon as the start code of the identification signal has been completely written into the shift register 14, the start code detector 16 releases the parity check device 15 through conductor 18. Thereafter the bits of the recognition code which succeed the start code are written into register 14, followed by the stop code bits. When the stop code detector 17 recognizes the stop code, it supplies a "high" signal to an input of AND gate 19, the output signal of the parity check device 15 being supplied to another input of the AND gate 19. If the parity of the recognition code bit is correct, the parity check device 15 also supplies a "high" signal at the instant that the stop code detector supplies a "high" signal, causing the AND gate 19 to supply a "high" signal at its output. The output of the AND gate 19 is connected to an input of an AND gate circuit 20. The shift register 14 is connected to another input of the AND gate 20, the output being connected to buffer 21. When the signal supplied by the AND gate 19 becomes "high", the contents of the shift register are entered, either in series or in parallel, in dependance on the design of this AND gate circuit, into the buffer 21 where it is available for further processing.

Owing to the high noise level which is peculiar to the field of application of these devices, the accuracy of the signal written into buffer 21 is small. This accuracy cannot be increased by using redundancy codes for the identification signal as this would cause the maximum permissible vehicle speed to be reduced.

To increase the accuracy considerably, the device is provided with a carrier period detector 22 and switching means connected to this detector to adjust the receiver to the initial position and to cause the interrogation unit to supply an interrogation signal, during the reception of an identification signal, when it is detected that the carrier signal is absent for at least one period. To this end the carrier period detector 22 is connected to the output of the trigger circuit 12 and to the clock-pulse generator 8.

Figure 2:
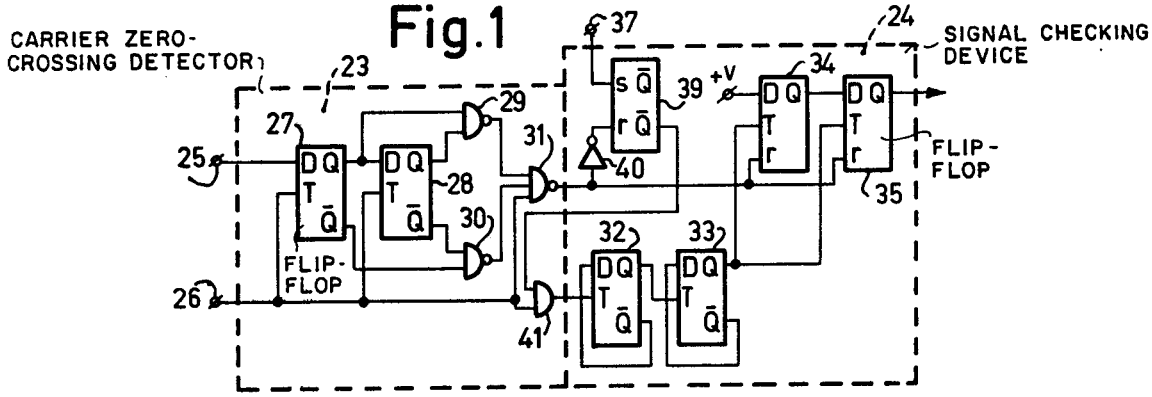
FIG. 2 shows a carrier period detector for use in the system according to FIG. 1, and FIGS. 3-1 through 3-11 show some signals to which the carrier period detector shown in FIG. 2 operates.
Figure 3:
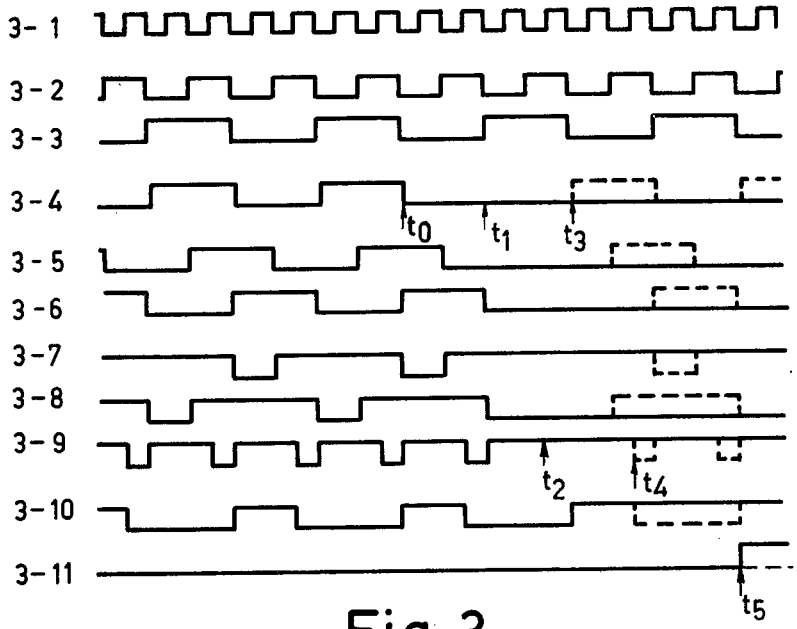

As shown in detail in FIG. 2, the carrier period detector 22 comprises a carrier zero-crossing detector 23 and a signal checking device 24. The rectangular bivalent signal derived by trigger circuit 12 from a 90 or 100 kHz carrier signal received, is fed to input terminal 25. This rectangular bivalent signal is shown in FIG. 3–4 where the signal amplitude is plotted as a function of time, which also applies to the signals shown in FIGS. 3–1 to 3–11. The clock-pulse train delivered by the clock-pulse generator 8 and shown in FIG. 3–1 is supplied to input terminal 26 at a repetition frequency of 400 kHz.

The bivalent signal is fed to input terminal 25 and is supplied to signal input D of D-flip-flop 27, which is the first of two cascade-connected D flip-flops 27 and 28. The clock pulse train is fed, via input terminal 26, to the counting input T of flip-flop 27. As is known, a D flip-flop is adjusted by the signal level fed to the signal input D so that, at the moment a negative-going edge occurs in the clock pulse train, the signal Q delivers this signal level. This means that the signal output Q of the D flip-flop 27 delivers the input signal as shown in FIG. 3–4, which is synchronized at the instants the negative-going edges of the clock pulse train occur, as an output signal as shown in FIG. 3–5, and that the output signal of signal output Q of the D flip-flop 28, as shown in FIG. 3–6, is the output signal of the D flip-flop 27 shifted one clock pulse period.

The signals of the signal outputs Q of the D flip-flops 27 and 28 are fed to a NAND-gate 29, whose output signal is shown in FIG. 3–7, whereas the signals of the inverse signal outputs $\overline{Q}$ are fed to a NAND-gate 30, whose output signal is shown in FIG. 3–8. The output signals of the NAND-gates 29 and 30 are fed to a NAND-gate 31 together with the clock pulse train which is applied to input terminal 26. Every second period of the clock pulse train the output signals obtained in this way from the NAND-gate 31, is shown in FIG. 3–9, shows a "low" signal level during one half of a clock pulse period, as long as changes in level occur in the signal fed to the input terminal 25. As described above, these changes in level occurring in the input signal correspond to zero-crossings occurring in the carrier signal received so that the zero-crossing detector 23 delivers a negative pulse of a duration of one half of a clock pulse train for each zero-crossing occurring in the carrier signal received.

This signal is fed to the signal checking device 24 which comprises the cascade circuit of two D flip-flops 34 and 35 which are connected as 2-scalers to which the clock pulse train fed to input terminal 26 is supplied through AND-gate 41. The signals delivered by these 2-scalers 32 and 33 are shown in FIGS. 3-2 and 3-3 respectively.

Furthermore the time-checking device 24 comprises two D flip-flops 34 and 35 connected in cascade to whose counting inputs T the clock pulse train delivered by the cascade circuit of 2-scalers 32 and 33 is fed and to whose reset inputs *r* the signal delivered by the zero-crossing detector 23 is fed. Signal input D of flip-flop 34 is connected to a voltage source +V which supplies a "high" signal level to this input.

Each time a negative-going edge occurs in the clock pulse train delivered by 2-scaler 33, D flip-flop 34 is set to the set state and the signal output Q delivers a signal of a "high" level as shown in FIG. 3–10. The negative pulses delivered by the zero-crossing detector 23 set D flip-flop 34 each time to the reset state within one period of the clock pulse series, as long as an undisturbed carrier signal is received, so that the D flip-flop 35 cannot be set to the set state.

As soon as a noise signal is received, the carrier signal in the limiter-amplifier 11 is suppressed and the trigger circuit 12 supplies a signal of constant level wich is shown in FIG. 3–4 by a solid line after the instant $t_0$. The absence of zero-crossings in the carrier signal at instants $t_1$ and $t_3$ (see the solid line in FIG. 3–4) results in that the output signal of the zero-crossing detector 23, see FIG. 3–9, does not show negative changes in the signal (see FIG. 3–9, in particular the signal levels designated by solid lines at the instants $t_2$ and $t_4$). The absence of the negative-going edge at $t_4$ means the D flip-flop 34 will not reset so that the negative-going edge of the clock pulse train (FIG. 3–3) sets the D flip-flop 35 to the set state whereupon its signal output Q delivers a "high" signal level as shown in FIG. 3–11.

However, if the carrier signal returns before the instant $t_3$ (see the dashed lines in FIG. 3–4 to 3–11) the D flip-flop 34 is reset at the instant $t_4$ and the signal level of the output Q of the D flip flop 35 remains low, so that the outputs of the carrier period detector does not deliver a signal of a "high" level until at least two successive zero-crossings in the carrier signal have failed to come, i.e., after one period. In this way it is prevented that at a possible sudden phase change in the carrier signal at the change from 100 kHz to 90 kHz or vice versa the carrier signal would energize the carrier period detector 22, owing to the transmission of two successive bits of different information content so that a zero-crossing might be skipped. It should be mentioned that such phase changes can be avoided by including a low-pass filter in the carrier signal path.

The output signal of the carrier period detector 22 is fed to a switching means 42, 43 and 38, shown in FIG. 1, which in this embodiment are the resetting inputs of shift register 14, the parity check device 15 and the logic circuit 9, which is constructed as a counter, respectively. A "high" signal level of the output signal of period detector 22 resets the shift register 14 and the parity check device 15 and consequently the receiver and also resets the logic circuit 9. Logic circuit 9 is constructed in such a way that in its initial state it supplies a control signal to the control input 5, for example the base of a transistor of the circuit 6, so as to control the main current path of a transistor to close the circuit 6, which causes a new interrogation signal to be transmitted.

This latter measure ensures that when the carrier signal is absent for at least one period the interrogation procedure for the identification of a vehicle is repeated. This greatly reduces the influence of noise signals while, particularly in the case of a relatively long interference or a succession of several short interferences, the likelihood of detecting a vehicle is considerably increased without reducing the maximum vehicle speed.

It is to be observed that when a larger number of cascade-connected D flip-flops is chosen for the time checking device, the number of consecutive times a zero-crossing may be absent in the carrier signal before an output signal is delivered will be accordingly larger.

However, two cascade-connected D flip-flops are preferably used.

To prevent an identification signal from energizing the carrier period detector 22 at the end of a flawless transmission of an identification signal, because the carrier signal drops out, so that the interrogation procedure would immediately be restarted, the output of the stop code detector 17 is connected to an input 37 of the carrier period detector 2 via a conductor 36. As shown in FIG. 2, this input 37 is connected to the setting input 5 of a bistable element 39, the signal delivered by the zero-crossing detector 23 being fed to reset input *r* through an inverter 40, while the inverse signal output $\overline{Q}$ is connected to the AND gate 41.

As soon as stop code detector 17 recognizes the stop code it supplies a "high" level signal which sets the bistable element 39 which blocks AND gate 41. This causes the signal checking device 24 to be switched off.

As soon as another carrier signal is received, the zero-crossing detector 23 resets the bistable element 39 through inverter 40, whereby the AND gate 41 releases the signal checking device 24.

What is claimed is:

1. A vehicle identification system for interrogating vehicles of the type having a response unit including means for transmitting a characteristic identification signal modulated on a carrier signal, said system comprising, an interrogation unit including means for the wireless transmission of an interrogation signal to a vehicle response unit, and a signal receiver having an initial state and means for detecting said identification signal transmitted by wireless from the response unit in reply to an interrogation signal from the interrogation unit, said receiver further comprising a carrier period detector with means for detecting, during the reception of an identification signal, the absence of the carrier signal for a given small number of periods, and switching means connected to and controlled by the carrier period detector for resetting the receiver to the initial state in response to a control signal supplied by the carrier period detector upon detection of said absence of the carrier signal.

2. A system as claimed in claim 1 further comprising means connecting the carrier period detector to the interrogation unit for causing the interrogation unit to transmit an interrogation signal when, during the reception of an identification signal, the absence of said carrier signal for a given small number of periods is detected.

3. A system as claimed in claim 1 wherein the carrier period detector comprises a zero-crossing detector and a signal checking device connected to the output of the zero-crossing detector for deriving said control signal.

4. A system as claimed in claim 1 wherein the carrier period detector produces said control signal when the carrier signal is absent for at least one period.

5. A system as claimed in claim 1 wherein said receiver further comprises, trigger circuit means responsive to a received carrier signal for deriving at its output a repetitive rectangular waveform signal whose amplitude transitions coincide with the zero-crossings of the carrier signal, said trigger circuit means being responsive to the reception of a given noise signal to suppress the carrier signal and thereupon terminate said rectangular waveform signal, and wherein said carrier detector includes means responsive to the output of the trigger circuit means for generating said control signal upon termination of the rectangular waveform for at least one period of the carrier signal.

6. A system as claimed in claim 1 wherein said receiver further comprises, trigger circuit means responsive to a received carrier signal for deriving at its output a repetitive rectangular waveform signal whose amplitude transitions coincide with the zero-crossings of the carrier signal, said trigger circuit means being responsive to the reception of a given noise signal to suppress the carrier signal and thereupon terminate said rectangular waveform signal, and wherein said carrier period detector comprises, first and second bistable devices each having a clock input terminal, a control input terminal, and first and second complementary output terminals, first, second and third NAND gates, means connecting the clock input terminals of said first and second bistable devices to a source of clock pulses, means connecting a first input of the third NAND gate to said source of clock pulses, means connecting the control input terminal of the first bistable device to the output of the trigger circuit means, the first output terminal thereof to the control input terminal of the second bistable device and to one input of the first NAND gate and the second output terminal to one input of the second NAND gate, means connecting the first and second outputs of the second bistable device to second inputs, respectively, of the first and second NAND gates, means connecting the outputs of the first and second NAND gates to second and third inputs, respectively, of the third NAND gate, and means connecting the output of the third NAND gate to an input of a signal checking device that responds thereto to derive said control signal.

7. A system as claimed in claim 6 wherein said signal checking device comprises bistable means having a reset input coupled to the output of the third NAND gate, frequency dividing means connected to said source of clock pulses to derive a binary waveform signal at a submultiple frequency of the clock pulse frequency, means for applying said binary signal to a clock input of said bistable means, means for applying a fixed binary signal to a control input of the bistable means, and means for deriving the control signal at an output of the bistable means.

8. A system as claimed in claim 1 wherein said receiver further comprises, trigger circuit means responsive to a received carrier signal for deriving a rectangular output signal whose amplitude transitions coincide with the zero-crossings of the carrier signal, and wherein said carrier period detector comprises, a zero-crossing detector responsive to said rectangular output signal and to a source of clock pulses to derive a sequence of pulse-type signals at a frequency that is a sub-multiple of the clock pulse frequency, and a signal checking device including bistable circuit means responsive to said pulse-type signals and to said source of clock pulses for deriving said control signal upon the absence of a given number of said pulse-type signals.

9. A system as claimed in claim 1 wherein said receiver further comprises, trigger circuit means responsive to a received carrier signal for deriving a rectangular output signal whose amplitude transitions coincide with the zero-crossings of the carrier signal, said trigger circuit means including an amplifier-limiter stage coupled to receive the carrier signal in cascade with a trigger circuit, a demodulator coupled to the output of the trigger circuit, and signal code identification means coupled to the output of the demodulator, and wherein said carrier period detector comprises a zero-crossing detector responsive to said rectangular output signal.

10. A system as claimed in claim 1 wherein said switching means is coupled to said interrogation unit for causing the interrogation unit to switch over into the interrogation mode when the carrier period detector detects the absence of a carrier signal for at least one period thereof during the transmission time of the carrier signal from the vehicle response unit.

* * * * *

UNITED STATES PATENT OFFICE

CERTIFICATE OF CORRECTION

Patent No. 4,068,211 Dated January 10, 1978

Inventor(s) NICOLAAS VAN TOL

It is certified that error appears in the above-identified patent and that said Letters Patent are hereby corrected as shown below:

IN THE CLAIMS

Claim 5, line 9, "carrier detec-" should read

--carrier period detec- --.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*